US005842895A

United States Patent [19]

DeVito, Jr.

[11] Patent Number: 5,842,895

[45] Date of Patent: Dec. 1, 1998

[54] TROLLING MOTOR MOUNTING MEANS

[75] Inventor: Richard D. DeVito, Jr., Stuart, Fla.

[73] Assignee: Southern Marine, Inc., Stuart, Fla.

[21] Appl. No.: 937,836

[22] Filed: Sep. 25, 1997

[51] Int. Cl.[6] ..... B60L 11/02

[52] U.S. Cl. ..... 440/6; 114/285

[58] Field of Search ..... 440/6, 53, 61–63; 114/284–287; D12/317

[56] References Cited

U.S. PATENT DOCUMENTS

| | | | |
|---|---|---|---|
| 4,832,642 | 5/1989 | Thompson | 114/285 |
| 5,017,165 | 5/1991 | Havins | 440/6 |
| 5,704,308 | 1/1998 | Anderson | 114/285 |

*Primary Examiner*—Ed L. Swinehart

*Attorney, Agent, or Firm*—Kilgannon & Steidl

[57] ABSTRACT

A trolling motor mount with a first plate hingedly connected at its front to the bottom of the boat transom, a second plate or a continuation of the first plate is connected to and extends rearwardly of the rear of the first plate at a predetermined substantial angle to the plane of the first plate. Fasteners are provided to attach a trolling motor to the underside of the second plate. Pivot brackets connect an electrically actuatable piston to the first plate and the top of the boat transom, the first plate being operable by the piston to a first position in the water to serve as a trim tab with the second plate and trolling motor extending upwardly out of the water, the first plate being operable to a second lower position in the water with the second plate and underlying trolling motor being immersed at an approximately horizontal trolling position below cavitation level in the water.

7 Claims, 2 Drawing Sheets

FIG. 1
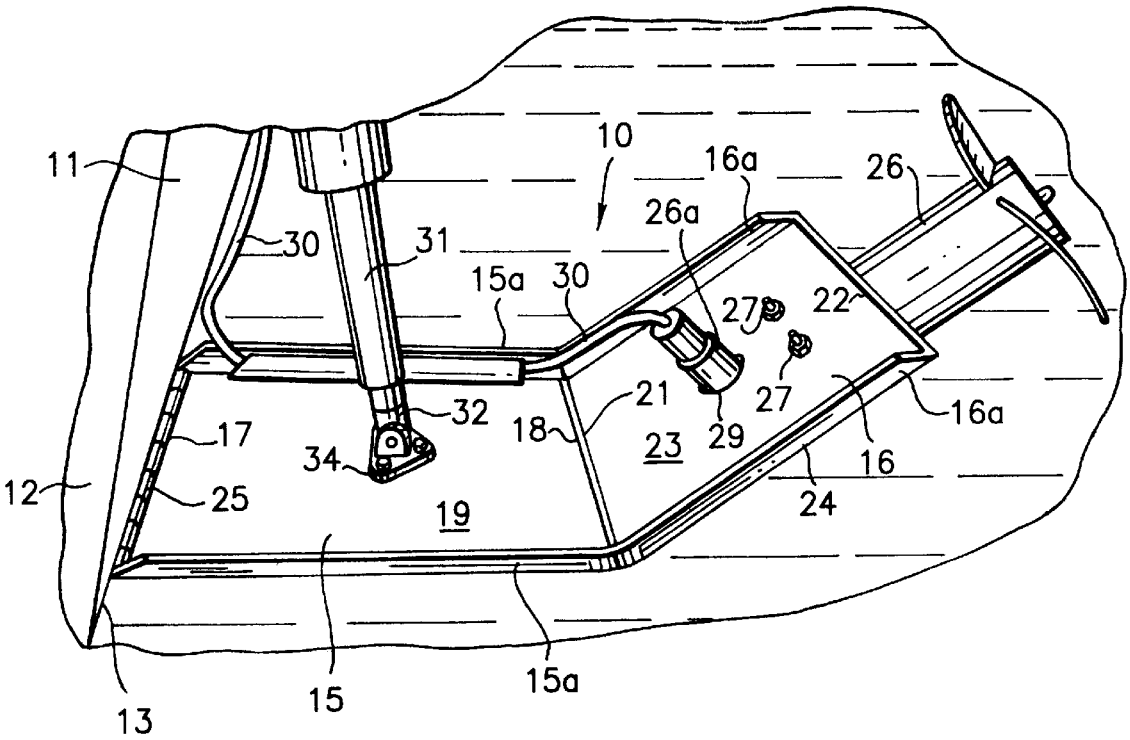
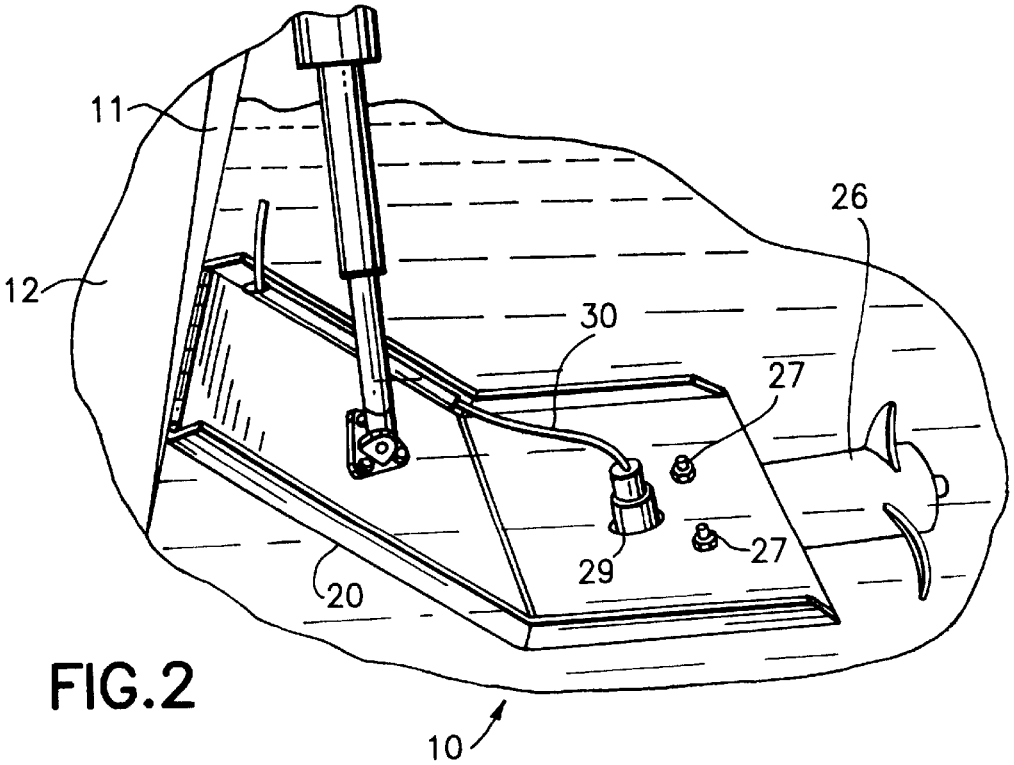
FIG. 2

TROLLING MOTOR MOUNTING MEANS

FIELD OF THE INVENTION

The present invention relates to a trolling motor mount for fishing boats operated at low speed by one or more trolling motors. The present invention also relates to boats which operate through use of a main motor at higher operating speeds and which utilize trim tabs to fine tune the orientation of the boat at the higher running speed.

BACKGROUND OF THE INVENTION

Boats used for sport fishing often utilize one or more low-powered trolling motors directly mounted onto the rear transom of the boat on one or both sides of the high-powered main motor. The main motor mounted to the transom is utilized to drive the boat when it traverses between port and the selected fishing area, or from one fishing area to another. When the boat reaches the desired fishing area, the main motor is angularly elevated out of the water, often by electrical and hydraulic means, and the trolling motors are angularly lowered into the water. The type of trolling motors commonly used do not have electrical means to raise and lower the motor in and out of the water, thus necessitating the manual operation thereof.

Prior to or after trolling operation, the trolling motors are raised out of the water, the main motor is lowered into the water, and the boat is driven at higher running speed. During the higher speed operation, it is known to utilize planar trim tabs or plates attached to the bottom of the transom on each side of the main motor. Each trim tab is operated by a piston from an out-of-the-water position to a position whereby the planar tab extends down into the water. The extent that the planar tab extends into the water can be varied by the piston so that the front to rear and side to side orientation of the boat can be fine tuned while operating at higher running speed.

It is also known to mount the trolling motor directly on the top of the planar trim tab or plate, the plate then serving as both the trim tab in one position and as a trolling motor mount in a second lower position. However, such a mounting system has not been found to operate satisfactorily for reasons including that the trolling motor is angled into the water, the trolling motor's operation is partly obstructed, and the trolling motor cannot be positioned sufficiently below the surface of the water and in the proper orientation to prevent cavitation.

Thus, present mounting systems for trolling motors have the above-noted inherent disadvantages.

SUMMARY OF THE INVENTION

The present invention is intended to overcome the deficiencies of the above-noted prior art. A trolling motor mount is disclosed whereby the trolling motor may be automatically rather than manually raised from, or lowered to, its non-obstructed full operational position immersed in the water at a sufficient depth to avoid cavitation. Further, a portion of the motor mount may be utilized as a trim plate when the trolling motor is automatically raised out of the water.

The trolling motor mount of the present invention includes a first planar plate having its front edge hingedly attached to the rear of the boat transom adjacent the bottom thereof. A second planar plate (or continuation of the first plate) has its front edge or end attached to the rear of the first plate, the second planar plate extending rearwardly at a predetermined substantial angle from the plane of the first plate. A trolling motor is attached to the bottom of the second plate. A controllable piston is connected between the top of the first plate and the upper part of the boat transom. When the boat is operating at running speed under the power of the main motor, the first plate can be rotated about its hinge connection to the transom to a first position where the first plate will act as a trim tab or plate. In this first position, the second plate extends upwardly out of the water and consequently the trolling motor on the bottom of the second plate also extends upwardly out of the water. When it is desired to operate the boat for trolling, the main motor is turned off and elevated out of the water. The first plate is then rotated about its hinge connection to a second position lower than the first position extending sufficiently down into the water such that the second plate and trolling motor attached to its bottom are immersed at an approximately horizontal trolling position in the water. The first plate does not obstruct the operation of the trolling motor since the trolling motor is attached to the bottom of the second plate and is lower in the water than both the first and second planar plates. The trolling motor, by virtue of being attached to the bottom of the second plate, is also sufficiently below water line to avoid cavitation affecting the operating characteristics of the motor. Electrical control wiring extends from the trolling motor to control means in the boat.

Other features and advantages of the present invention will be apparent from the following description, drawings and claims.

BRIEF DESCRIPTION OF THE DRAWINGS

FIG. 1 is a perspective view of the present invention, with the first plate of the trolling motor mount in its first position and the second plate and trolling motor positioned and extending at a substantial angle out of the water;

FIG. 2 is a perspective view of the present invention, with the first plate of the trolling motor mount in its second, lower, position and the second plate and its underlying trolling motor immersed in operational position in the water;

DETAILED DESCRIPTION OF EMBODIMENT

Figure 3:
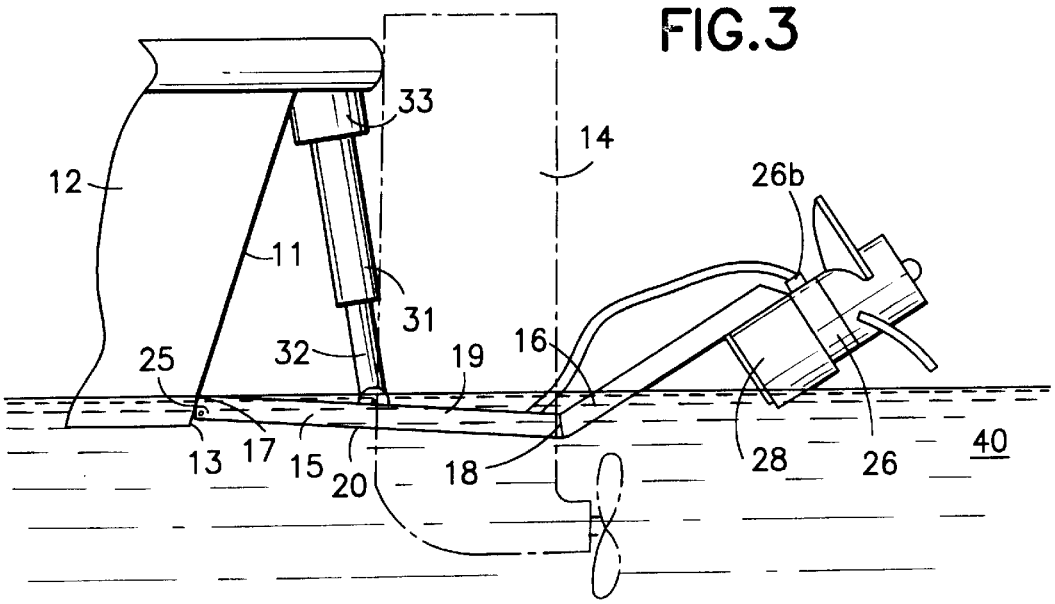
FIG. 3 is a side view corresponding to FIG. 1.
Figure 4:
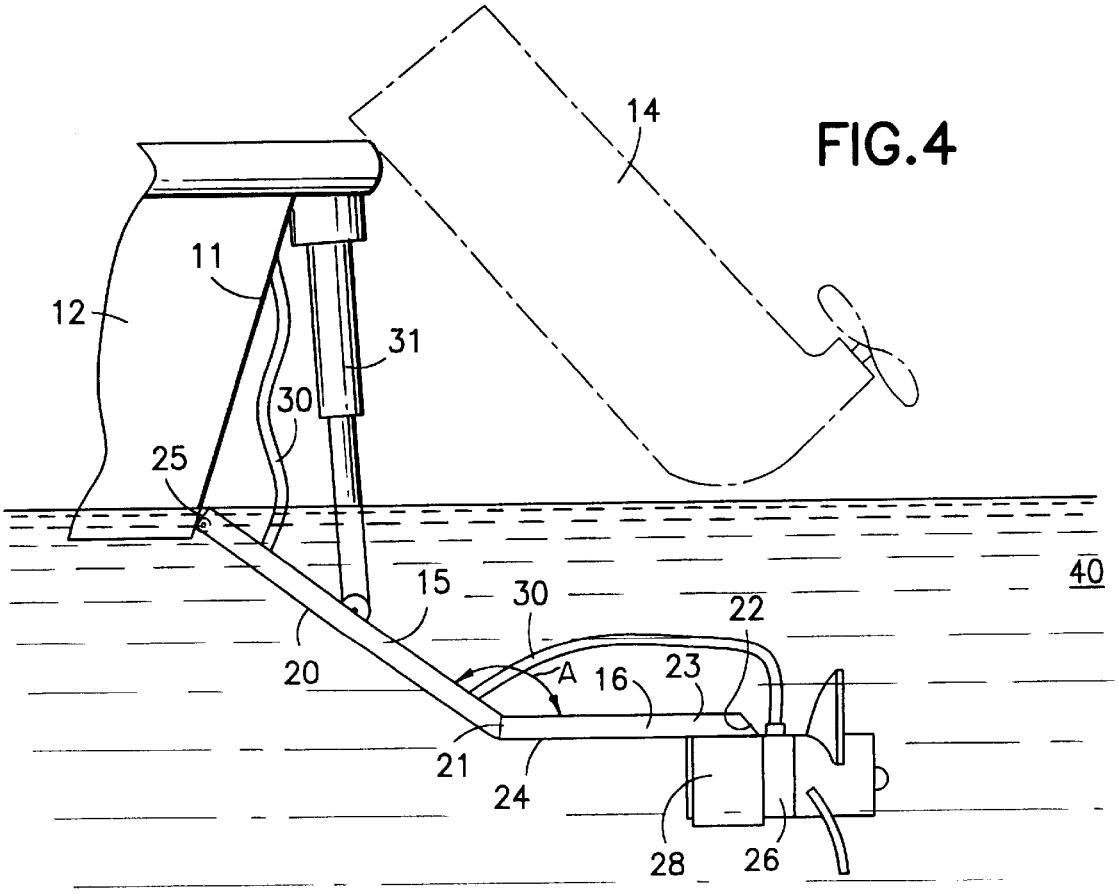
FIG. 4 is a side view corresponding to FIG. 2.

Reference is made to FIGS. 1–4, illustrating trolling motor mount 10 attached to the rear transom 11 of boat 12 adjacent the bottom 13 of transom 11. One trolling motor mount 10 may be attached on each side of the transom 11, with the main power motor for the boat positioned therebetween in its usual position. FIGS. 3 and 4 schematically illustrate power motor 14 in dotted lines.

Trolling motor mount 10 includes a first metal plate 15 and a second metal plate 16. Plate 15 has front edge 17, rear edge or end 18, top 19 and bottom 20. Plate 16 has front edge or end 21, rear edge 22, top 23 and bottom 24. Plates 15 and 16 have upwardly turned side reinforcing members **15*a* and 16*a*. The front edge 17 of first plate 15 is attached to transom 11 by hinge 25 so that plate 15 can pivot upwardly toward the transom 11 and downwardly away from the transom 11. Hinge 15 will be parallel to the underlying bottom of transom 11**, which bottom may be flat in a flat-bottomed boat or which may be angled downwardly toward the boat center line at a small angle in boats with a corresponding hull profile.

The front edge or end 21 of plate 16 is fixedly attached to rear edge or end 18 of plate 15 to extend rearwardly at a predetermined substantial angle from the plane of plate 15. Plates 15 and 16 can be also combined as one integral structure if desired, by bending a single metal plate to assume the shape of plates 15 and 16. Reinforcing members 15*a* and 16*a* are welded together at the point of joinder where ends 18 and 21 meet. Electrical trolling motor 26 is attached to the bottom of second plate 16 by any convenient means, for example nuts and bolts 27 passing through a frame or yoke 28 capturing the body of the trolling motor 26. A portion 26*a* of the trolling motor 26 may pass through opening 29 in plate 16, and electrical connections 30 are there connected to the trolling motor, all as shown in FIGS. 1 and 2. Or, electrical connections 30 may be attached to the motor at 26*b* as shown in FIGS. 3,4. Electrical connections 30 in turn extend into boat 12 to a control position in the boat.

Piston 31 is attached at its lower end 32 to the top 19 of first plate 15 by pivot bracket 34. The upper end 33 of piston 31 is attached to the upper part of transom 11 of boat 12 or structure thereabove by a further pivot bracket. Piston 31, which may be operated by an electrical motor or may be a hydraulic piston, is electrically controlled from within boat 12. When piston 31 is actuated to a first extended position, plate 15 will extend into the water as indicated in FIG. 3 and will act as a trim tab to fine-tune the orientation of boat 12 at higher speeds in known fashion. Slight control adjustments of piston 31 about this first position allow slightly different trim plate angles to be used. At the higher speeds, power motor 14 extends into the water and is the driving force for boat 12. As shown in FIG. 3, trolling motor 26 extends upwardly out of the water because of the substantial angle between plate 15 and 16. Trolling motor 26 accordingly does not interfere in this position with the higher running speed operation of the boat nor with boat hole shot operation.

When piston 31 is actuated to a second more extended position, plate 15 extends substantially down into the water as indicated in FIGS. 2 and 4. This position is used for trolling operation of boat 12, with power motor 14 lifted out of the water as shown in FIG. 4. Second plate 16 with its underlying trolling motor 26 now extends substantially horizontally in the water.

Piston 31 also has a non-extended position, not shown, wherein plate 15 extends substantially horizontally and does not function as a trim tab, if such is desired at certain boat speeds or during storage or trailering.

Merely as an example, plate 15 may extend front to rear a distance of thirteen inches; plate 16 may extend front to rear a distance of ten inches; the angle A (see FIG. 4) between plates 15 and 16 may be one hundred and forty-one degrees; and piston 31 can be infinitely varied in position from its non-extended to its fully-extended position over a distance of four and one-half inches. A suitable piston 31 may be a Lenco 101 EL piston. When the trolling motor 26 is in its operating position of FIGS. 2 and 4, the motor is approximately twelve inches below the water surface 40 to avoid cavitation.

As can now be appreciated, the boat operator can automatically raise and lower the electric trolling motor 26 from inside the boat without the need to manually raise or lower the trolling motor.

It will be appreciated by persons skilled in the art that variations and/or modifications may be made to the present invention without departing from the spirit and scope of the invention. The present embodiment is, therefore, to be considered as illustrative and not restrictive. Merely as an example, plate 16 may be an open framework rather than a closed plane for mounting trolling motor 26. Further, two trolling motors 26 may be mounted on each plate 16 for use with larger boats. Trolling motor 26 also can be mounted to the top of plate 16, though less advantageously to its operation. It should also be understood that such terms as "front", "rear", "upper", "lower", "top" and "bottom", and corresponding similar positional terms as used in the specification are intended in relation to the positioning shown in FIGS. 1–4, and are not otherwise intended to be restrictive.

What is claimed is:

1. A trolling motor mount for use with a boat, comprising a first plate having a front end and a rear end and a top and bottom, means for hingedly attaching the front end of the first plate to the rear transom of the boat adjacent the bottom of the transom, a second plate having a front end and a rear end and a top and bottom, the front end of the second plate being attached to or continuous with the first plate adjacent the rear end of the first plate to extend rearwardly at a predetermined substantial angle from the plane of the first plate, means for attaching a trolling motor to the second plate, a controllable piston and means for attaching the controllable piston to the top of the first plate, whereby the first plate can be rotated by the piston to a first position with the second plate extending upwardly out of the water, and to a lower, second position extending sufficiently down into the water such that the second plate and attached trolling motor are immersed at an approximately horizontal trolling position in the water.

2. The invention of claim 1, wherein the trolling motor is attached to the bottom of the second plate.

3. The invention of claim 2, wherein the first plate is of sufficient size to act as a trim tab when the first plate is rotated by the piston to said first position.

4. The invention of claim 1, including the controllable piston being electrically actuated and having a first end pivotally connected to the first plate and a second end pivotally connected to the boat transom.

5. The invention of claim 2, including trolling motor control means operated from the boat and electrically connected to the trolling motor.

6. The invention of claim 1, wherein the predetermined substantial angle is approximately one hundred and forty-one degrees.

7. The invention of claim 1, wherein the second plate is an integral angular extension of the first plate.

* * * * *